US011186978B2

(12) United States Patent
May et al.

(10) Patent No.: US 11,186,978 B2
(45) **Date of Patent: *Nov. 30, 2021**

(54) MODULE AND METHOD FOR MANAGING WATER AND OTHER FLUIDS

(71) Applicant: StormTrap LLC, Romeoville, IL (US)

(72) Inventors: Justin Ivan May, Morris, IL (US); Tom Heraty, Naperville, IL (US); Philip J. Burkhart, Mazon, IL (US)

(73) Assignee: StormTrap LLC, Romeoville, IL (US)

( * ) Notice: Subject to any disclaimer, the term of this patent is extended or adjusted under 35 U.S.C. 154(b) by 243 days.

This patent is subject to a terminal disclaimer.

(21) Appl. No.: 16/380,595

(22) Filed: Apr. 10, 2019

(65) Prior Publication Data

US 2019/0234059 A1 Aug. 1, 2019

Related U.S. Application Data

(60) Continuation of application No. 15/221,348, filed on Jul. 27, 2016, now Pat. No. 10,267,028, which is a continuation of application No. 14/298,450, filed on Jun. 6, 2014, now Pat. No. 9,428,880, which is a division of application No. 12/553,732, filed on Sep. 3, 2009, now Pat. No. 8,770,890, which is a continuation-in-part of application No. 29/333,248, (Continued)

(51) Int. Cl.

| | |
|---|---|
| ***E03F 1/00*** | (2006.01) |
| ***E01F 5/00*** | (2006.01) |
| ***E02B 13/00*** | (2006.01) |
| ***E02D 29/00*** | (2006.01) |
| ***E02B 11/00*** | (2006.01) |

(52) U.S. Cl.

CPC ..... *E03F 1/002* (2013.01); *E01F 5/00* (2013.01); *E01F 5/005* (2013.01); *E02B 11/005* (2013.01); *E02B 13/00* (2013.01); *E02D 29/10* (2013.01); *Y10T 137/6991* (2015.04)

(58) Field of Classification Search

CPC . E03F 1/002; E03F 1/003; E03F 1/005; E01F 5/005; E02B 11/005; Y01T 137/6991; E04B 1/04

USPC ..... 52/86–89, 169.1, 169.2, 169.6; 405/36, 405/28, 43, 46, 50, 51, 118, 124, 126

See application file for complete search history.

(56) References Cited

U.S. PATENT DOCUMENTS

| | | |
|---|---|---|
| 862,292 A | 8/1907 | Stoffer |
| 925,019 A | 2/1909 | Parks et al. |

(Continued)

FOREIGN PATENT DOCUMENTS

| | | |
|---|---|---|
| CA | 969 382 A | 6/1975 |
| FR | 2 927 913 A | 8/2009 |

(Continued)

OTHER PUBLICATIONS

Extended European search report from corresponding EP patent application 20171884.8, dated Jan. 26, 2021.

(Continued)

*Primary Examiner* — Tara Mayo-Pinnock

(74) *Attorney, Agent, or Firm* — Levenfeld Pearlstein, LLC

(57) ABSTRACT

A method for managing the flow of water beneath a ground surface uses modules. Assemblies of such modules are disclosed. The modules include supports and a deck portion, and the supports are spaced apart and form multiple channels with a main section of the deck portion. The deck portion also includes at least one section extending from a main section.

27 Claims, 6 Drawing Sheets

Related U.S. Application Data filed on Mar. 5, 2009, now Pat. No. Des. 617,867, which is a continuation of application No. 14/303,037, filed on Jun. 12, 2014, now Pat. No. 9,464,400.

(56) References Cited

U.S. PATENT DOCUMENTS

| | | | |
|---|---|---|---|
| 1,028,638 | A | 6/1912 | Thorsby |
| 1,060,271 | A | 4/1913 | McBean et al. |
| 1,144,200 | A | 6/1915 | Hewett |
| 1,184,634 | A | 5/1916 | Duerrwachter |
| 1,349,166 | A | 8/1920 | Paff |
| 1,412,616 | A | 4/1922 | Kammerer et al. |
| 1,453,136 | A | 4/1923 | Hitchcock |
| 2,095,024 | A | 10/1937 | Boosey |
| 2,184,137 | A | 12/1939 | Arthurs |
| 2,477,256 | A | 7/1949 | Kneas |
| 2,900,083 | A | 8/1959 | Oliver |
| 3,339,366 | A | 9/1967 | Gogan et al. |
| 3,570,251 | A | 3/1971 | Roberts |
| 3,626,823 | A | 12/1971 | Toth |
| 3,821,869 | A | 7/1974 | Morgan |
| 3,878,656 | A | 4/1975 | Duwe et al. |
| 3,910,051 | A | 10/1975 | Komisarek |
| 3,962,839 | A | 6/1976 | Ickes |
| 4,027,439 | A | 6/1977 | Willard |
| 4,141,666 | A | 2/1979 | DeGraff |
| 4,211,504 | A | 7/1980 | Sivachenko |
| 4,239,416 | A | 12/1980 | Borca et al. |
| 4,314,775 | A | 2/1982 | Johnson |
| 4,523,613 | A | 6/1985 | Fouss et al. |
| 4,595,314 | A | 6/1986 | Lockwood |
| 4,638,920 | A | 1/1987 | Goodhues, Jr. |
| 4,687,371 | A | 8/1987 | Lockwood |
| 4,759,661 | A | 7/1988 | Nichols et al. |
| 4,797,030 | A | 1/1989 | Lockwood |
| 4,854,775 | A | 8/1989 | Lockwood |
| 4,993,872 | A | 2/1991 | Lockwood |
| 5,134,741 | A | 8/1992 | Carcassi |
| 5,336,017 | A | 8/1994 | Nichols |
| 5,401,116 | A | 3/1995 | Nichols |
| 5,624,204 | A | 4/1997 | Dorsemaine |
| 5,810,510 | A | 9/1998 | Urriola |
| 5,836,716 | A | 11/1998 | Johnson et al. |
| 5,890,838 | A | 4/1999 | Moore, Jr. et al. |
| 6,004,067 | A | 12/1999 | Peppard |
| 6,221,445 | B1 | 4/2001 | Jones |
| 6,277,274 | B1 | 8/2001 | Coffman |
| 6,322,288 | B1 | 11/2001 | DiTullo |
| 6,361,248 | B1 | 3/2002 | Maestro |
| 6,368,017 | B2 | 4/2002 | Black |
| 6,922,950 | B2 | 8/2005 | Heierli |
| 6,991,402 | B2 | 1/2006 | Burkhart |
| 7,160,058 | B2 | 1/2007 | Burkhart |
| 7,344,335 | B2 | 3/2008 | Burkhart |
| 8,113,740 | B2 | 2/2012 | Boulton et al. |
| 2004/0076473 | A1 | 4/2004 | Burkhart |
| 2005/0204671 | A1 | 9/2005 | Heuvel et al. |
| 2006/0034662 | A1 | 2/2006 | Burkhart |
| 2007/0099477 | A1 | 5/2007 | Burkhart |
| 2008/0166182 | A1 | 7/2008 | Smith et al. |

FOREIGN PATENT DOCUMENTS

| | | | |
|---|---|---|---|
| FR | 2927913 | | 8/2009 |
| GB | 191216232 | | 4/1913 |
| GB | 2 219 813 | A | 12/1989 |
| GB | 2219813 | A | 12/1989 |
| GB | 2266647 | A | 11/1993 |
| JP | 2-34306 | Y2 | 9/1990 |
| JP | H06-26091 | A | 2/1994 |
| JP | H06-32395 | A | 2/1994 |
| JP | 6-9100 | Y2 | 3/1994 |
| JP | H11-107229 | A | 4/1994 |
| JP | 7-3861 | | 1/1995 |
| JP | H07-1169 | | 1/1995 |
| JP | H07 247593 | A | 9/1995 |
| JP | 8-120746 | | 5/1996 |
| JP | 2504690 | B2 | 6/1996 |
| JP | 2000-213014 | | 8/2000 |
| JP | 2000 213014 | A | 8/2000 |
| JP | 2001-107442 | A | 4/2001 |
| WO | 84/03658 | A1 | 9/1984 |

OTHER PUBLICATIONS

English language Abstract for JP patent application 2000 213014, dated Aug. 2, 2000.

English language Abstract for FR patent application 2 927 913, dated Aug. 28, 2009.

City of Chicago Department of Aviation, drawing of project installed at Midway Airport, Oct. 16, 2002, 1 page.

http:www.structuremag.org/archvies/2006/July-2006-C-SP-Double-Tee-Reder-July-06.pdf magazine article on double tee beams, Structure magazine, Jul. 2006, pp. 28-29.

Advanced Drainage Systems, Inc., "When was the last time a footprint meant so much?", Advertisement, Stormwater, Sep./Oct. 2002, p. 3.

Stormtech, "Profit from the ground up with StormTech's gold chambers", Advertisement, Stormwater, Sep./Oct. 2002, p. 11.

Hydrologic Solutions, "StormChamber The Most Effective BMP!", Advertisement, Stormwater, Sep./Oct. 2002, p. 34.

Invisible Structures, Inc., "Total Stormwater Management", Advertisement, Stormwater, Sep./Oct. 2002, p. 35.

Tilton, Joseph Lynn, "Helping Stormwater Keep Its Place", Stormwater, Sep./Oct. 2002, p. 40-41, 44, 46, 48-51.

Contech Construction Products Inc. "Meet NPDES Requirements with Contech's Stormwater Treatment Train of Structural BMPs", Advertisement, Stormwater, Sep./Oct. 2002, p. 42-43.

Stormtrap, "Modular Storm Water Detention System", Advertisement, Stormwater, Sep./Oct. 2002, p. 47.

Mar-Mac Manufacturing, Inc., Advertisement, including photographs and drawings for assembly installed and completed near O'Hare Airport in 2001, 10 pages.

Illinois Department of Transportation, Standard 602101-01, Jan. 1, 1997, 1 page.

Illinois Department of Transportation, Standard 602006, an. 1, 1997, 1 page.

Stormtrap drawings prepared by ECOCAST Ltd., for installation in Plainfield, IL, Aug. 1998, 9 pages.

Stormtrap advertisements, StormTrap website, Feb. 2002.

Sep. 30, 2010 PCT Search Report and Written Opinion (International App. No. PCT/US2010/04730).

Dukane Precast Storm Water Management System Completed Project List as of Mar. 2010.

Premiere Dermatology Dukane Drawings w/Double Tees, detention system installed in 2009 at Premier Dermatology in Crest Hill, Illinois, 6 pages.

Summary of Office Action for corresponding MX patent application MX/a/2011/008865, dated Apr. 27, 2015 (5 pgs.).

Supplemental European Search Report for corresponding EP patent application EP10814140.9, dated Jan. 30, 2015 (6 pgs.).

FIG. 8
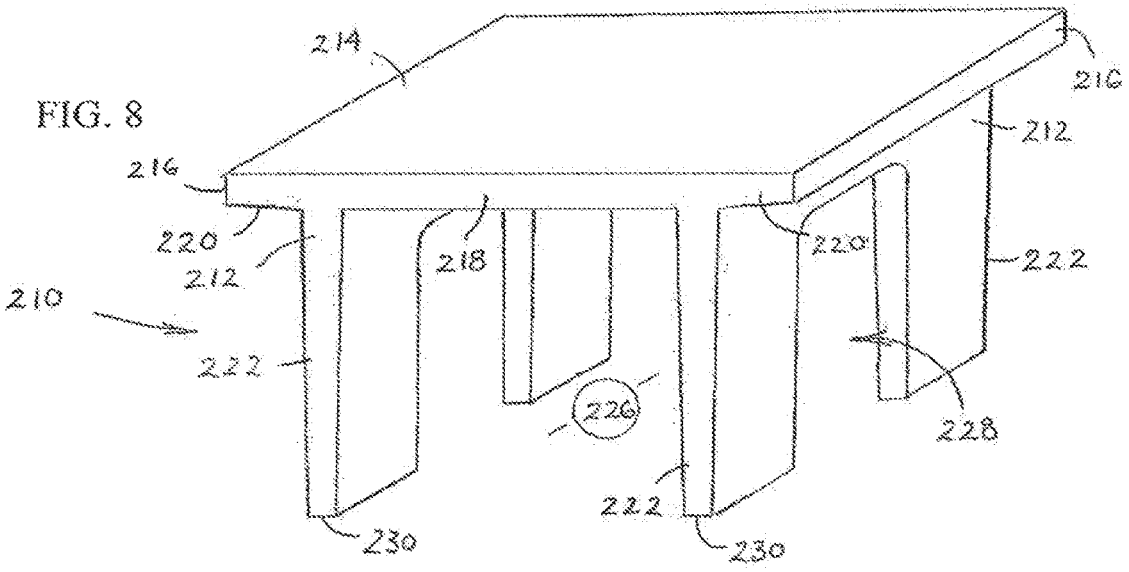
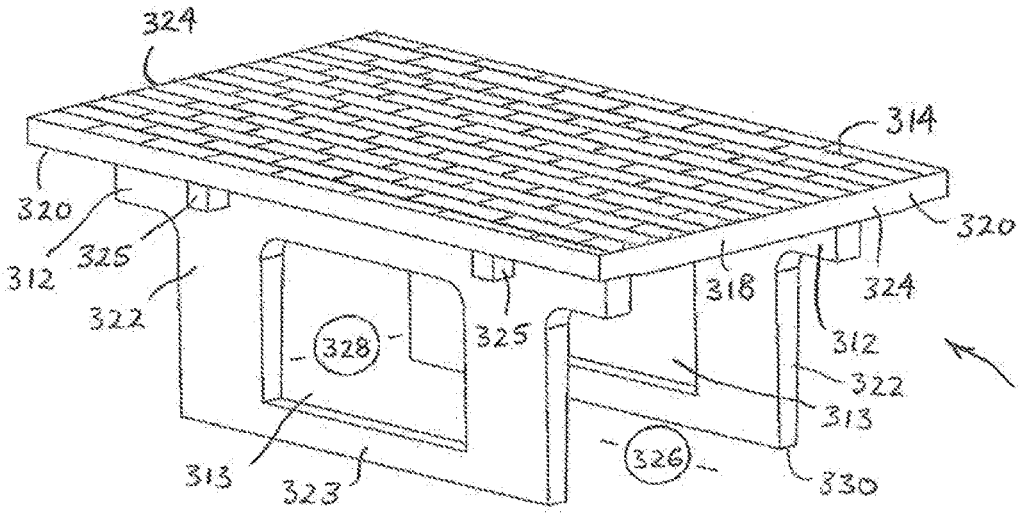
FIG. 9
FIG. 10
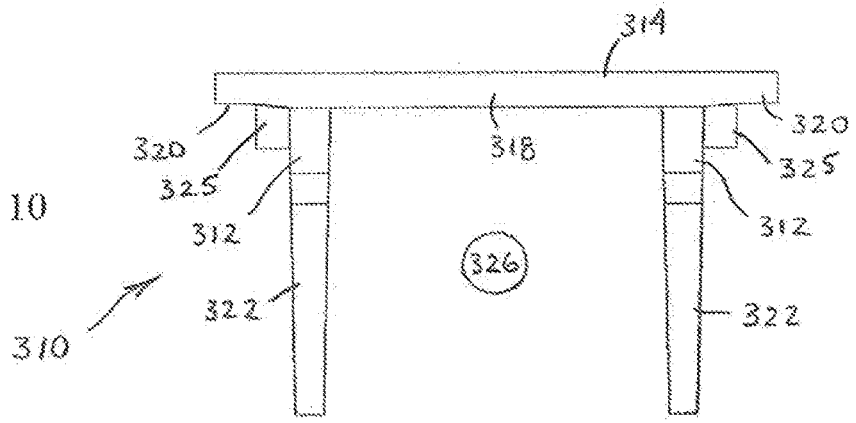

FIG. 11
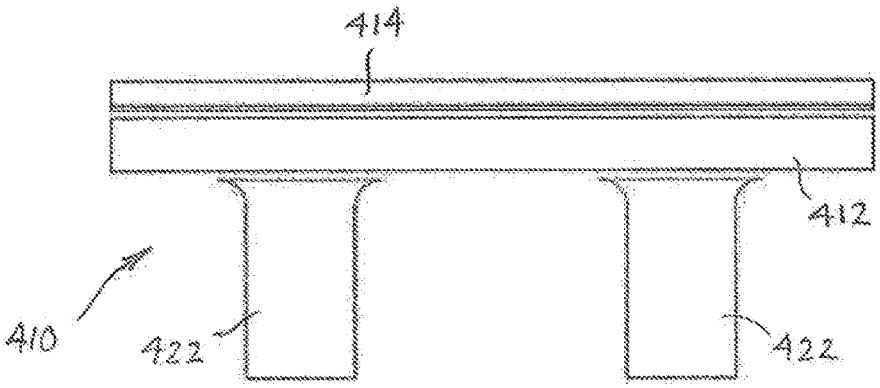
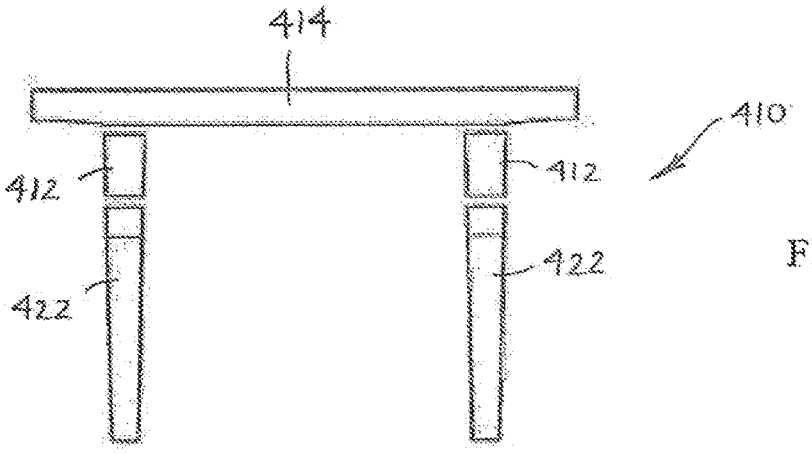
FIG. 12
FIG. 13
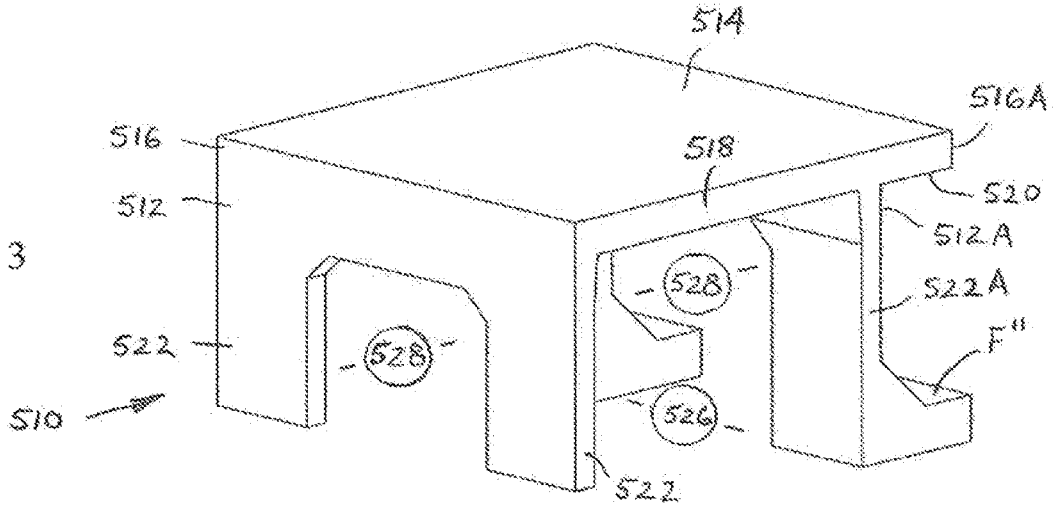

MODULE AND METHOD FOR MANAGING WATER AND OTHER FLUIDS

CROSS-REFERENCE TO RELATED APPLICATIONS

This application is a continuation application of U.S. patent application Ser. No. 15/221,348 filed on Jul. 27, 2016, now allowed which is a continuation of U.S. patent application Ser. No. 14/298,450 filed on Jun. 6, 2014 which issued on Aug. 30, 2016 as U.S. Pat. No. 9,428,880, and U.S. patent application Ser. No. 14/303,037 filed on Jun. 12, 2014 which issued on Oct. 11, 2016 as U.S. Pat. No. 9,464,400 which are each divisional applications of Ser. No. 12/553,732 filed on Sep. 3, 2009 which issued on Jul. 8, 2014 as U.S. Pat. No. 8,770,890 which is a continuation-in-part of U.S. Design Application No. 29/333,248 filed Mar. 5, 2009 which issued on Jun. 15, 2010 as U.S. Design Pat. No. D617,867. This application claims priority from each of the above-referenced applications, the disclosures of which are hereby incorporated by reference in its entirety as if set forth fully herein.

BACKGROUND

The present disclosure generally relates to managing the flow of and more specifically the retention or detention of fluids, such as storm water. Water retention and detention systems accommodate runoff at a given site by diverting or storing water, preventing pooling of water at a ground surface, and eliminating or reducing downstream flooding.

An underground water retention or detention system generally is utilized when the surface area on a building site is not available to accommodate other types of systems such as open reservoirs, basins or ponds. Underground systems do not utilize valuable surface areas as compared to reservoirs, basins or ponds. They also present fewer public hazards than other systems, such as by avoiding having open, standing water which would be conducive to mosquito breeding. Underground systems also avoid aesthetic problems commonly associated with some other systems, such as algae and weed growth. Thus, it is beneficial to have an underground system to manage water effectively.

One disadvantage of current underground systems is that they must accommodate existing or planned underground facilities such as utilities and other buried conduits. At the same time, an underground water retention or detention system must be effective in diverting water from the ground surface to another location. Therefore, it would be advantageous to provide a modular underground assembly which has great versatility in the plan area form it can assume.

Another disadvantage of current underground systems is that they often fail to provide relatively unrestricted water flow throughout the system. It would be preferable instead to provide systems which can permit relatively unconstrained flow throughout their interior.

Depending on the location and application, underground systems often must be able to withstand traffic and earth loads which are applied from above, without being prone to cracking, collapse or other structural failure. Indeed, it would be advantageous to provide underground systems which accommodate virtually any foreseeable loads applied at the ground surface in addition to the weight of the earth surrounding a given system. Such systems also preferably may be constructed in ways that are relatively efficient in terms of the cost, fluid storage volume and weight of the material used, as well as the ease with which the components of the systems can be shipped, handled and installed.

Modular underground systems are taught in StormTrap LLC U.S. Pat. Nos. 6,991,402; 7,160,058 and 7,344,335 ("the Burkhart Patents"), each of which is incorporated by reference in its entirety.

The present disclosure relates to the configuration, production and methods of use of modules, which are preferably fabricated using precast concrete and are usually installed in longitudinally and laterally aligned configurations to form systems having underground channels for managing the flow of, retaining and/or detaining water.

Different forms of underground water retention and/or detention structures have been either proposed or made. Such structures commonly are made of concrete and attempt to provide large spans, which require very thick components. The structures therefore are very massive, leading to inefficient material usage, more difficult shipping and handling, and consequently higher costs. Other underground water conveyance structures such as pipe, box culvert, and bridge culvert have been made of various materials and proposed or constructed for particular uses. However, such other underground structures are designed for other applications or fail to provide the necessary features and above-mentioned desired advantages of the modular systems disclosed herein.

SUMMARY

The present disclosure is directed, in some of its several aspects, to a module and a modular assembly for managing the flow of water beneath a ground surface. The modules have unique configurations that permit thinner components. This facilitates a reduction in material usage, weight and cost, with easier shipping and handling.

In one example, a module is disclosed for use in an assembly for managing the flow of water beneath a ground surface. The module includes at least two supports, a deck portion having a main section located on top of the at least two supports and at least one secondary section extending from the main section. The supports are spaced apart and together with the main section define an interior channel. At least one of the supports has at least one leg section spaced from ends of the deck portion.

In another example, an assembly for managing the flow of water beneath a ground surface is disclosed and includes a plurality of modules with each module having a deck portion and each deck portion being placed adjacent at least one other deck portion of another module. Each module further includes at least two supports with the at least two supports being spaced apart and together with the deck portion forming an interior channel. A deck portion of at least one of the modules also includes at least one section extending beyond the interior channel.

Another example assembly for managing the flow of water beneath a ground surface is disclosed as having at least one first module that includes at least two supports, a deck portion including a main section located on top of the at least two supports, with the supports being spaced apart and together with the main section defining an interior channel. The deck portion further includes a section extending beyond the interior channel, and at least one of the supports has at least two leg sections spaced from ends of the deck portion. The at least two leg sections are spaced apart and define a support channel therebetween. The example assembly further includes a plurality of side modules, with each side module including a deck portion, and at least two supports disposed below the deck portion. The supports are spaced apart and together with the deck portion define an interior channel. Within the example assembly, each deck portion of the first and side modules is placed adjacent at least one other deck portion of either one of the plurality of side modules or the at least one first module.

A further example assembly for managing the flow of water beneath a ground surface is disclosed, with the assembly having at least one first module that includes a deck portion having a main section and first and second cantilevered sections, at least two supports disposed below the main section, and with the supports being spaced apart and together with the deck portion defining an interior channel. The assembly also includes a plurality of side modules, with each side module including a deck portion, at least two supports disposed below the deck portion, and the supports being spaced apart and together with the deck portion defining an interior channel. Each deck portion of the first and side modules is placed adjacent at least one other deck portion of either one of the plurality of side modules or the at least one first module. Also, a first of the supports and a first of the cantilevered sections of the at least one first module together with a support of an adjacent module define an outer channel, and a second support and second cantilevered section of the at least one first modules together with a support of an adjacent module defines another outer channel, wherein the outer channels are in fluid communication with the interior channel of the at least one first module.

DETAILED DESCRIPTION OF THE DRAWINGS

FIG. 8 is an upper perspective view of another example module.

FIG. 9 is an upper perspective view of a further example module.

FIG. 10 is an end view of the module shown in FIG. 9.

FIG. 11 is a side exploded view of a further example module.

FIG. 12 is an end exploded view of the module shown in FIG. 11.

FIG. 13 is an upper perspective view of an example module that includes a support having an integral footing that also provides a footing for an adjacent module.

DETAILED DESCRIPTION

The present disclosure generally provides a module for an underground assembly to manage the flow of water. In one aspect, the disclosed modules provide great versatility in the configuration of a modular assembly. The modules may be assembled in any customized orientation to suit a plan area or footprint as desired for a particular application and its side boundaries. The modular assembly may be configured to avoid existing underground obstructions such as utilities, pipelines, storage tanks, wells, and any other formations as desired. Some of the modules that may be used in particular configurations of an underground assembly to manage the flow of water also are sold by StormTrap LLC of Morris, Ill., under the trademark STORMTRAP®.

The modules are configured to be preferably positioned in the ground at any desired depth. For example, the topmost portion of an assembly of modules may be positioned so as to form a ground surface or traffic surface such as, for example, a parking lot, airport runway or tarmac. Alternatively, the modules may be positioned within the ground, underneath one or more layers of earth. In either case, the modules are sufficient to withstand earth, vehicle, and/or object loads. The example modules are suitable for numerous applications and, by way of example but not limitation, may be located under lawns, parkways, parking lots, roadways, airports, railroads, or building floor areas. Accordingly, the preferred modules give ample versatility for virtually any application while still permitting water flow management and more specifically, water retention or detention.

In another aspect, the module permits water to flow within its interior volume which is defined by channels that will be described in detail herein. The channels are generally defined by a deck portion and at least two supports. Preferably, these channels occupy a relatively large proportion of the volume defined by the module. The module design permits a large amount of internal water flow while minimizing the excavation required during site installation and minimizing the plan area or footprint occupied by each module.

Figure 1:
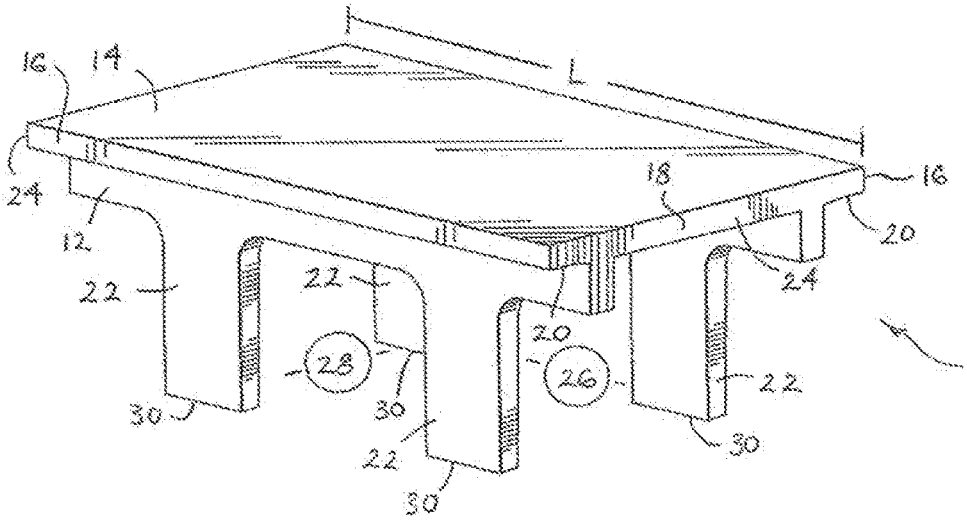
FIG. 1 is a upper perspective view of a first example module for an assembly for managing the flow of water beneath a ground surface.
Figure 2:
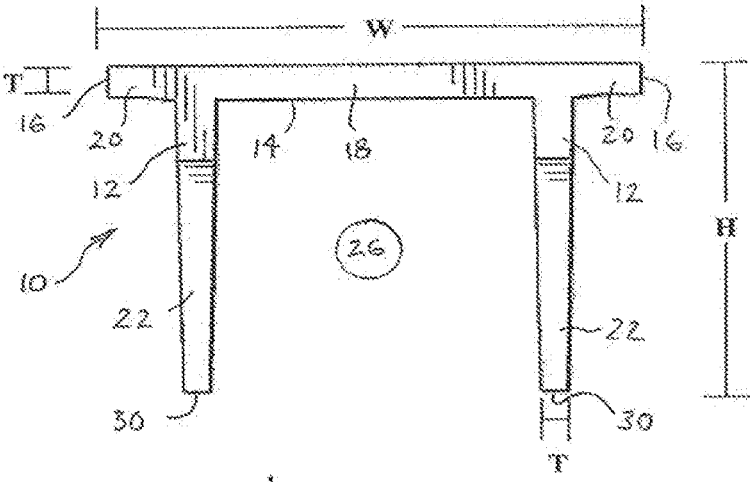
FIG. 2 is an end view of the module shown in FIG. 1.

Turning to the drawing figures of the disclosure, FIGS. 1 and 2 illustrate an example module, generally designated at 10, for use in an assembly for managing the flow of water beneath a ground surface. The illustrated module 10 includes two supports 12 and a deck portion 14 located on top of the supports 12. The supports 12 are positioned underneath the deck portion 14 and spaced from longitudinal sides 16 of the deck portion 14. The supports 12 extend from the deck portion 14 and rest on a solid base or footing, such as footings F shown in FIG. 3.

The deck portion 14 may be in the form of any selected shape, but is shown in the preferred configuration as a rectangular slab. The deck portion 14 includes a main section 18 and at least one further section 20 extending from the main section 18. Preferably, the deck sections are integrally formed. The supports 12 also are spaced from the longitudinal sides 16, such that the sections 20 extending from the main section 18 are cantilevered or overhang from the supports 12. Sections 20 preferably are formed such that they need not be supported by an adjacent structure when installed. The supports 12 also are spaced apart from one another. The supports 12 may further include leg sections 22. In the illustrated example in FIGS. 1 and 2, each support 12 has two leg sections 22 that are spaced from ends 24 of the deck portion 14. However, it will be appreciated that more or fewer leg sections 22 may be configured for each support 12. In addition, more supports 12 may be positioned under the deck portion 14.

To manage the flow of water, the module 10 defines an interior channel 26 which is preferably open at the ends of the module 10. The interior channel 26 is defined by the supports 12 and the main section 18 of the deck portion 14. As shown in FIGS. 1 and 2, the interior channel 26 extends in the longitudinal direction of the module 10 to permit the flow of water in the longitudinal direction. The module 10 also may include support channels 28 in the lateral direction. In the embodiment illustrated, the leg sections 22 of each of the supports 12 are spaced apart to define a support channel 28 therebetween. Both the interior channel 26 and support channels 28 are in fluid communication with one another so as to permit water flow in the longitudinal and lateral directions.

As illustrated, each of the channels 26, 28 of the example module 10 in FIGS. 1 and 2 extends to the bottom surface 30 of the supports 12, and thus to a footing or floor on which the module 10 sits. This configuration allows for relatively unconstrained fluid flow through the module 10 regardless of the fluid level. However, it will be appreciated that there can be other configurations for the channels. For example, one or both of the ends of the interior channel may be sealed off to prevent any flow of water out of the interior channel in that direction. In addition, a support may be a solid wall that does not define a lateral channel. Alternatively, a channel may not extend to the bottom surface 30 of the supports 12, such as by forming a window opening in a support 12, rather than an opening that extends to the floor.

The channels 26, 28 are preferably quite large, so as to allow relatively unrestricted fluid flow therethrough. The large channel sizes also prevent clogging due to surface debris which may be swept into the modules 12 by the flow of storm water. While it is preferred that the channels 26, 28 have approximately the same cross-sectional size, other configurations are also possible. It is preferred that the configuration of the interior channel 26 occupies substantially the entire area between the supports 12. Similarly, it is preferred that each support channel 28 occupies substantially the entire area between the leg sections 22 of the support 12, and each support 12 may include one or more support channels 28. As is illustrated in FIGS. 1 and 2 the preferred shape of the support channels 28 is a downward-depending U-shape, for load distribution purposes, although other shapes such as squares or circles also may be used.

As illustrated in FIG. 1, the module 12 has an overall length L that typically is in the range of two feet to twenty feet or more, and preferably is approximately fourteen feet. As illustrated in FIG. 2, the span or width W of each module 12 typically may be two feet to ten feet or more and is preferably about eight and a half to nine feet. The thickness T of the deck portion 14 and supports 12 typically is in the range of five inches to twelve inches or more. By way of example, but not limitation, a thickness of seven inches has been found suitable for deck portions 14 having a width of up to nine and a half feet. The height H of the module 12 has an approximate range of two feet to twelve feet, and is preferably about five or six feet. It further is preferred that the channels 28 in the supports 12 have approximately the same cross-sectional size as one another. The height of each channel opening is in the range of approximately one foot to five feet, while the width of the channel opening is in the range of one foot to eight feet, and typically is approximately between four feet and seven feet, and preferably five feet. The sections 20 extending laterally from the main section 18 of the deck portion 14 may vary in the distance they extend in a cantilevered fashion from virtually no extension to up to over approximately one and a half feet.

The dimensions associated with these unique module constructions afford a significant savings in material, and therefore, a reduction in weight. The construction industry is often constrained by weight limits when transporting and moving materials; therefore, a weight reduction allows for greater efficiency. Prior art modules commonly have supports located at the outer edges of a deck, thereby requiring a deck construction having a selected thickness to achieve a given lateral span. The example modules disclosed herein include sections of a deck portion that extend from a main section, typically in a cantilevered fashion, although additional gussets may be utilized. The use of at least one support spaced inboard from the sides of a deck portion results in a shorter span of the deck portion between the supports, which means that the overall deck portion may be thinner to withstand the same load. A thinner deck portion uses less material, which reduces the weight of the deck. In turn, a lighter deck portion permits the use of less massive supports to carry the decreased load of the thinner deck portion. This also facilitates the use of less massive footings to carry the lighter weight deck portion and supports. Lighter weight also translates into greater ease in handling the large module structures, as well as potentially smaller equipment to move and haul the modules. This may result in lower equipment and shipping costs.

Depending on the particular designs, the use of thinner or lighter weight modules as disclosed herein may require modifications to certain portions of the modules. For instance, by way of example and not limitation, the supports may be somewhat tapered in thickness from the top to the bottom. This is evident in the example module 10 shown in FIG. 2 where the support is thicker at its upper section than at its lower section. Similarly, the leg sections 22 may tend to broaden at the top where they spread out into the longer longitudinal section of a support. In viewing FIG. 2, it also will be appreciated that the deck portion 14 may vary in thickness as a cantilevered portion 20 extends outward from the main section 18 and a support 12. That is, the outer sections 20, 120, 220, etc. of the illustrated deck portions may be tapered, as shown in many of the figures, where the deck portion extends outward from the support 12, 112, 212, 312, 412. As most visible in FIGS. 2, 3, 6, 8, 9, 10, and 12, the cantilevered sections 20, 120, 220, 320, and others that are not numbered (as in FIGS. 3, 5, 7, and 12) are tapered so that they are thicker where the support meets the deck portion. The underside of the deck portion then tapers in thickness to become thinner as one approaches the longitudinal (side) edge 16 of the module. The upper surface of the deck portion 14 lies in the same plane, as shown in the figures, while the tapering occurs on the underside of the cantilevered portions. Thus, the present disclosure illustrates examples of unique refinements in the design and construction of modules, which can provide significant advantages in weight and ultimately in handling and material costs.

As mentioned above, the modules 10 preferably are positioned in the ground and oftentimes underneath several layers of earth. Therefore, the modules 10 need to be constructed of a material that is able to withstand earth, vehicle, and/or object loads. Preferably, each module 10 is constructed of concrete, and more specifically precast concrete having a high strength. However, it will be appreciated that any other suitable material may be used.

Figure 3:
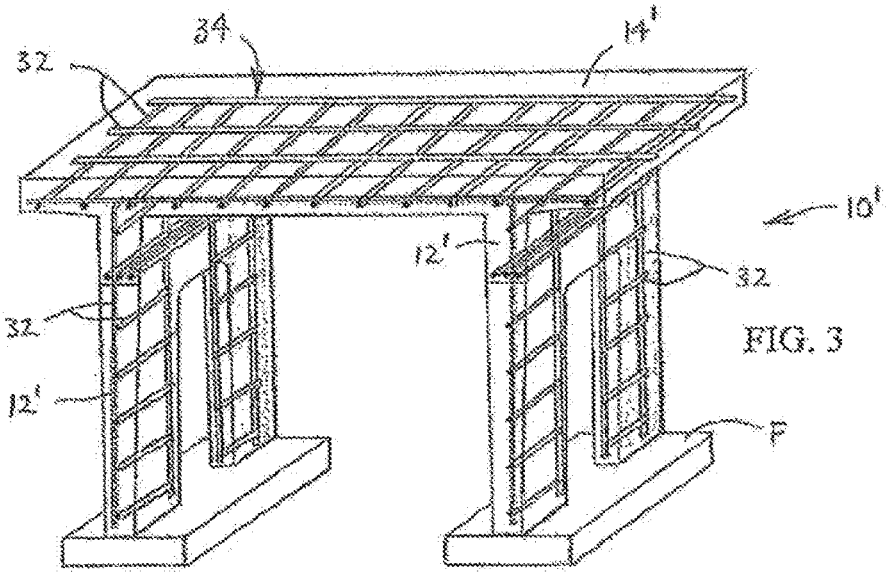
FIG. 3 is an upper perspective view showing an example of reinforcing elements within an outline of a module, such as the module shown in FIG. 8, and with the module sitting on footings.

As seen in a further example module 10' in FIG. 3, for added strength and structural stability, the modules 10' preferably are formed with embedded reinforcements, which may be steel reinforcing rods 32, prefabricated steel mesh 34 or other similar reinforcements. In the illustrated example module 10', the supports 12' and deck portion 14' preferably are formed as one integral piece.

The requirements for the size and location of such embedded reinforcements are dependent on the loads to which the module 10' will be subjected. The specific reinforcements for a particular module customarily are designed by a licensed structural engineer to work with the concrete to provide sufficient load carrying strength to support earth and/or traffic loads placed upon the modules. In place of the reinforcing bars or mesh, other forms of reinforcement may be used such as pre-tensioned or post-tensioned steel strands or metal or plastic fibers or ribbons. Alternatively, the modules may comprise hollow core material which is a precast, prestressed concrete having reinforcing, prestressed strands. Hollow core material has a number of continuous voids along its length and is known in the industry for its added strength. Where a module will be located at or beneath a traffic surface such as, for example, a parking lot, street, highway, other roadways or airport traffic surfaces, the module construction will meet American Association of State Transportation and Highway Officials (AASTHO) standards. Preferably, the construction will be sufficient to withstand an HS20 loading, a known load standard in the industry, although other load standards may be used.

When installed in an assembly, the supports and more specifically the leg sections of the modules are preferably placed on footings, pads or a floor. For example, a particular assembly design may specify the use of footings, such as footings F that are shown in FIG. 3, or may utilize a floor, such as the floor F' shown in FIG. 6. In either case, the added structure underlying the supports serves to distribute to the underlying soil the load of the module, as well as vertical loads placed on the module.

If using footings, the footings F may be positioned in a parallel and spaced orientation under the leg sections. The footings F preferably are made of concrete and may be precast or formed in-situ. The lateral distance between the footings preferably is filled with aggregate material or filter fabric material (not shown) to allow all or a portion of the water to be absorbed by the soil. The aggregate or fabric material preferably is placed between the footings and extends approximately to the top surface of the footings to form a flat layer for the bottom surface of a channel 26. The aggregate material may comprise any conventional material having a suitable particle size which allows water to be absorbed into the layers of earth beneath the assembly at a desired flow rate. Various filter fabrics also may be used. Alternatively, the area between the footings F may be filled with continuous in-situ concrete or a membrane forming a floor. The floor may be impervious except for an assembly outlet port. As described below in reference to further examples, a footing or floor also may be integrally formed with the bottom surfaces of the supports.

To create an assembly for management of water beneath a ground surface, multiple modules may be placed adjacent one another. In an assembly, the modules are preferably placed in side-by-side and/or end-to-end configurations. The assembly of modules may be arranged in what can be described as columns and rows. This is one way of combining modules in a reticulated configuration. Thus, a series of modules may be placed within an assembly in an end-to-end configuration to form what will be referred to as a first column. The first column is disposed along the longitudinal direction of the assembly. A second column of modules may be placed adjacent to and abutting the first column to form an array of columns and rows of modules. The rows are disposed along the lateral direction of the assembly. This configuration results in longitudinal channels being aligned with one another. Alternatively, it is possible to place modules in an offset or staggered orientation, such as, for example, an orientation commonly used for laying bricks, while still providing aligned channels. The length or width of the assembly of modules is unlimited and the modules may be situated to form an assembly having an irregular shape.

Figure 4:
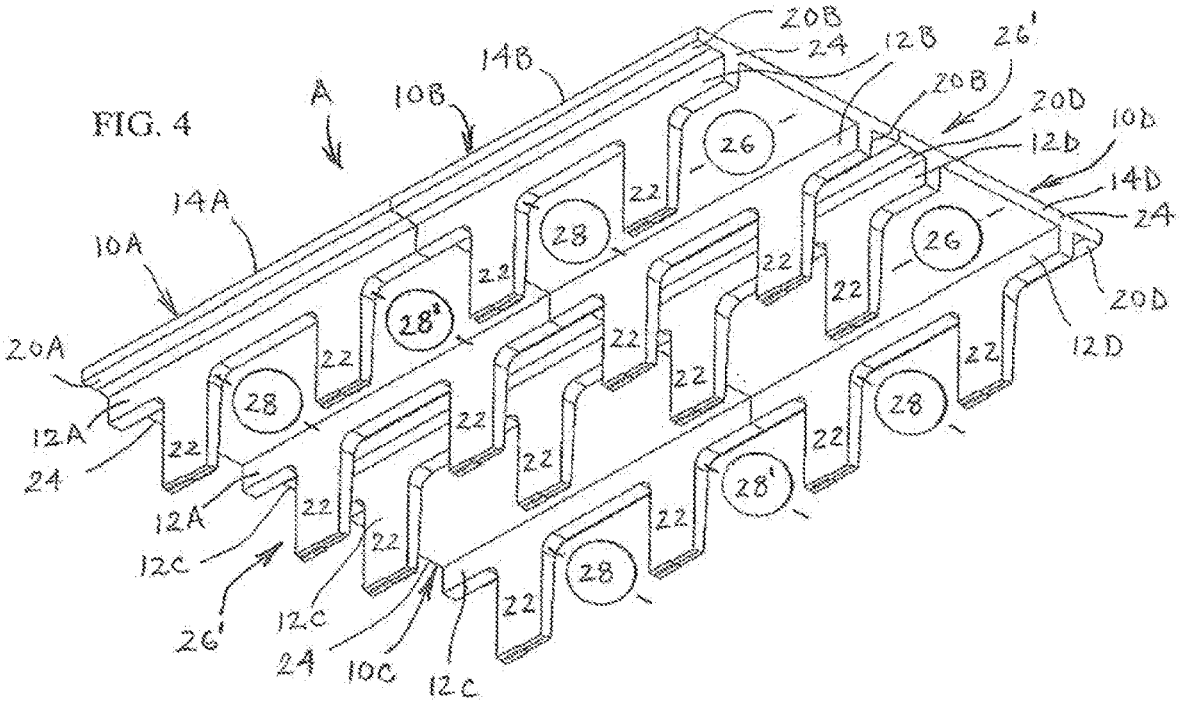
FIG. 4 is a lower perspective view of an assembly of four of the example modules shown in FIG. 1.

FIG. 4 illustrates an example assembly A formed with four of the modules 10 illustrated in FIGS. 1 and 2. The four modules are positioned such that a first deck portion 14 is placed adjacent another deck portion 14. In the illustrated assembly A, deck portion 14A is positioned end to end with deck portion 14B in a first column, and side to side with deck portion 14C in a first row. Likewise, deck portion 14C is positioned end to end with deck portion 14D in a second column, with deck portion 14B positioned side to side with deck portion 14D in a second row. The resulting configuration of the assembly A is generally rectangular. In order to connect the modules of the assembly A, the joints formed between the adjacent modules surfaces are typically sealed with a sealant or tape such as, for example, bitmastic tape, wraps, filter fabric or the like. It will be appreciated that this assembly A merely is an example of a portion of a larger assembly, and typically would be positioned within the interior of a larger complete assembly that may also include different modules, some of which will be described below.

The configuration illustrated in FIG. 4 results in the interior channels 26 of modules 10A and 10B being in fluid communication longitudinally, along with the interior channels 26 of modules 10C and 10D. In addition, a support 12B and a cantilevered portion 20B of module 10B together with a support 12D and a cantilevered portion 20D of module 10D define an outer channel 26'. Likewise, a support 12A and a cantilevered portion 20A (not shown) of module 10A together with a support 12C and a cantilevered portion 20C of module 10C define another outer channel 26'.

With respect to lateral flow, the support channels 28 of modules 10A and 10C are in fluid communication laterally along with the support channels 28 of modules 10B and 10D. In turn, with the respective leg sections 22 being spaced from the respective ends 24 of the deck portions 14, a further lateral channel 28' is formed by the spaced apart leg sections 22 of two modules 10 that are adjacent each other in an end-to-end placement. It will be appreciated that this configuration of an assembly A provides for relatively unconstrained water flow between the modules in both the longitudinal and lateral directions.

Figure 5:
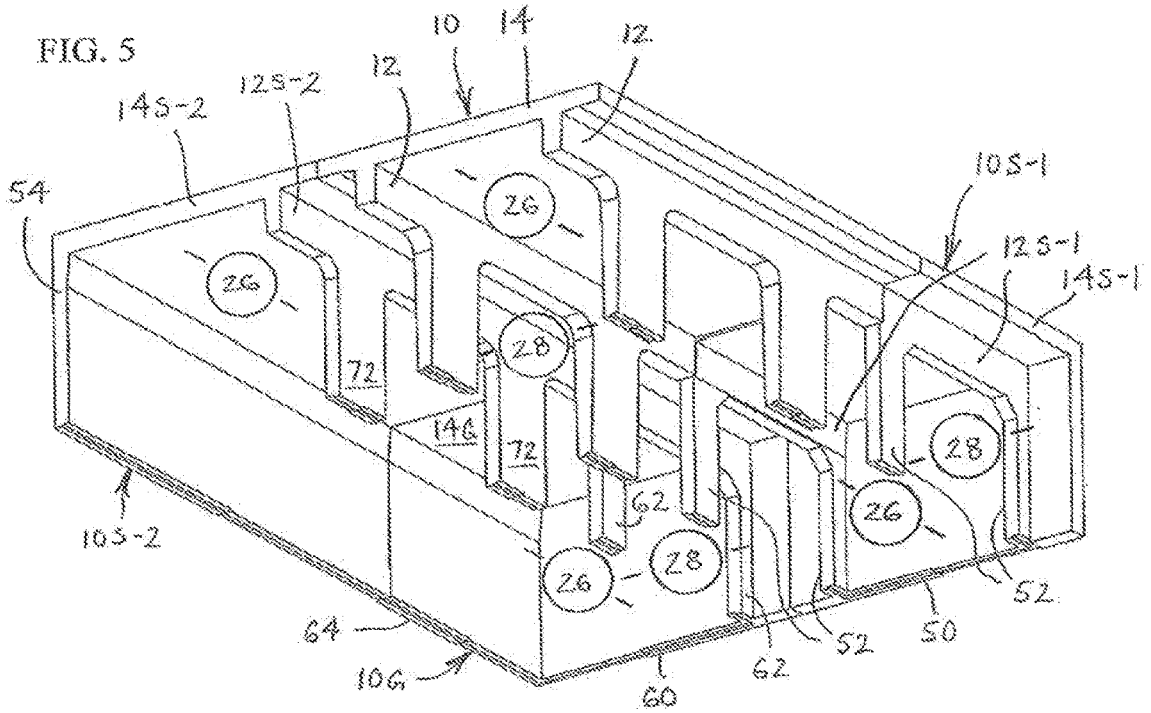
FIG. 5 is a lower perspective view illustrating an example of four modules forming an outer corner of an assembly.

There may be some instances where the assembly is used to detain or at least partially detain fluid. In these instances the assembly may be at least partially enclosed and may also include additional modules having closed walls. For example, as shown in FIG. 5, besides the first module 10, which is like the module depicted in FIG. 1, the assembly may also include side modules 10S-1 and 10S-2 and a corner module 10G. The side modules and corner module are disposed peripherally of the first module in FIG. 5 and have some of the same parts such that the same numbers will be used to designate like parts. It will be appreciated that other embodiments of modules also are possible at the periphery of the assembly. It also will be appreciated that in some instances modules with at least one closed wall may be included in the interior of the assembly. In the illustrated assembly, the four modules are positioned such that each deck portion is placed adjacent at least one other deck portion.

Due to the modular design, a plan area is not constrained to simple rectangular shapes. Rather, the modules may be combined in any desired free form plan area shape available within the constraints of the site. One skilled in the art will appreciate that various combinations of these four types of modules can be used to create assemblies that fit virtually any desired configuration.

Side module 10S-1 is one example of a side module which is somewhat similar to the first module 10 of FIG. 1, but it functions also to form an end of an assembly of modules. Side module 10S-1 includes a deck portion 14S-1 and two supports 12S-1 supporting the deck portion and spaced from the sides of the deck portion 14S-1. Side module 10S-1 also includes an end wall 50, which is a substantially vertical wall extending downward from the deck portion 14S-1 at one of the ends of the deck portion. Thus, the example end wall 50, without any openings, defines an end boundary of the assembly. It will be appreciated that an end wall may include an opening to communicate with other water management components, such as a pipe.

As a result of the structure of the example side module 1OS-1, the module has one closed longitudinal end. Together, the deck portion 14S-1 and the supports 12S-1 define an interior channel 26. The leg sections 52 of each of the support members 12S-1 are spaced apart to define a support channel 28 therebetween. In this example, the leg sections 52 are adjacent the end wall 50 at the outer end and are not spaced from the end of the deck portion 14S-1 at the opposite inner end. Both the interior channel 26 and support channels 28 are in fluid communication with one another so as to permit water flow in the longitudinal and lateral directions.

Side module 10S-2 is another example of a side module which is somewhat similar to the first module 10 of FIG. 1, but it functions also to form a side of an assembly of modules. Side module 10S-2 includes a deck portion 14S-2 and a support 12S-2 spaced inward from a longitudinal side of the deck portion 14S-2. Side module 10S-2 also includes a support 54 which extends from an outer longitudinal side of the deck portion 14S-2, rather than being spaced therefrom. Support 54 is a substantially vertical wall extending downward from the deck portion 14S-2 along one side of the deck portion, and thereby forms a side wall. Thus, the support 54 is a vertical wall with no openings that defines a side boundary of the assembly, although it will be appreciated that a side wall also may include an opening to communicate with other water management components, such as a pipe.

As a result of the structure of the example side module 10S-2, the module has one closed side. Together, the deck portion 14S-2 and the supports 12S-2, 54 define an interior channel 26. Support 12S-2 also includes leg sections 72 which are spaced apart and defines support channel 28 therebetween. Both the interior channel 26 and support channel 28 are in fluid communication with one another so as to permit water flow in the longitudinal and lateral directions.

The construction and dimensions of the side modules 10S-2 preferably are the same as that described for the first module, although other modifications are possible. In addition, as noted above, while the boundary walls, such as end wall 50 or side wall 54 are shown as being imperforate, it also is possible for these walls to include one or more inlet or outlet ports as necessary in order to allow inflow and outflow of water, as well as other fluids and solids carried by the fluids.

Corner module 10G incorporates into one module boundary walls somewhat similar to those of end wall 50 of side module 10S-1 and side wall 54 of side module 10S-2. In this way, the corner module 10G has one closed end wall 60 in the longitudinal direction and one closed side wall 64 which intersects the closed end wall 60 to form a corner of an assembly of modules. Thus, the closed walls 60, 64 of the corner module 10G define an outer boundary of an assembly. Corner modules 10G preferably are placed at corner locations of an assembly and the dimensions of the corner modules may be similar to the modules adjacent to them, such as described with respect to the module 10 shown in FIG. 1. However, it will be appreciated that the actual dimensions of a corner module 10G may vary, and may depend on the requirements of the particular plan site.

Similar to side module 10S-1, corner module 10G includes a deck portion 14G, a support 12G and the support 64 that forms a side wall. Together, these portions define an interior channel 26. The support 12G also includes leg sections 62 which are spaced apart to define a support channel 28 therebetween. In this example, a first leg section 62 is adjacent the end wall 60 at the outer end, and a second leg section 62 is not spaced from the end of the deck portion 14G at the opposite inner end. Each corner module preferably defines at least one interior channel 26 and at least one support channel 28, similar to those channels previously described in FIGS. 1 and 4, to allow relatively unconstrained fluid flow between the channels of the modules in an assembly.

Like the module described in FIG. 1, in a corner or side module, the supports, whether internal or formed as outer walls, as well as the deck portion, all preferably are formed as one integral piece and preferably are made of precast concrete having a high strength. In addition, the modules preferably are formed with embedded reinforcements which may be steel reinforcing rods, prefabricated steel mesh or other similar reinforcements. As mentioned above, it will be appreciated that other embodiments of side modules and corner modules may be integrated with the first modules that are shown in FIG. 1 to create an assembly. For example, the side and corner modules described in the Burkhart Patents, may be used to form sides and ends of an assembly, while using the modules 10 disclosed herein within the interior area of the assembly. Alternatively, an assembly may be constructed of numerous first modules and then surrounded by an exterior wall formed by the side modules disclosed herein, or of a different construction. Further, an assembly may be constructed with a plurality of interior modules described in the Burkhart Patents and surround by sides and corner modules described herein.

Figure 6:
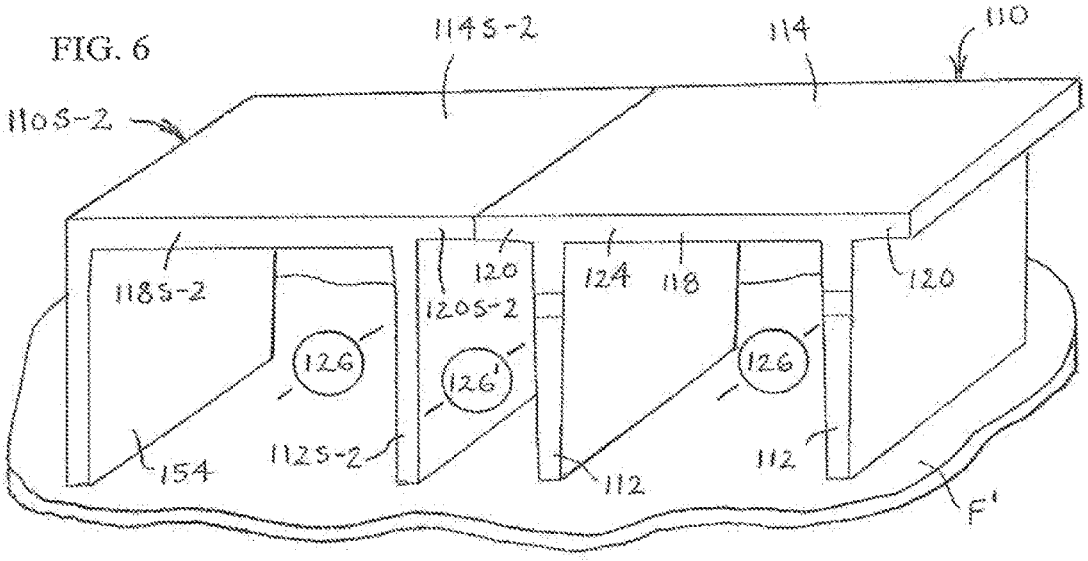
FIG. 6 is an upper perspective view of an interior module adjacent a side module, and with the modules sitting atop a floor.
Figure 7:
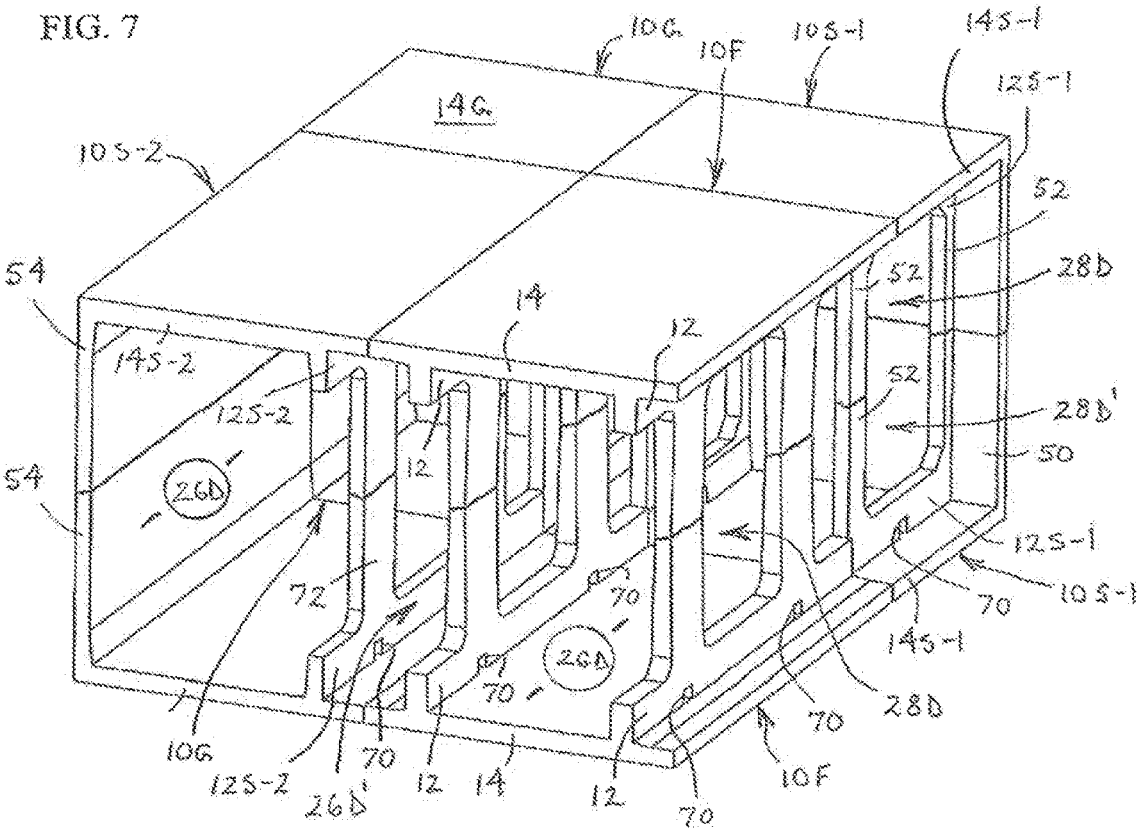
FIG. 7 is an upper perspective view illustrating another example of a corner of an assembly that includes a first set of modules inverted and forming a base and a second set of modules stacked atop the first set of modules.

As previously described, each module of the assembly is supported on top of some form of a footing or pad, although the underlying structure may be in the form of a floor. In one example, the footings F may be laid out and the modules 10 placed on top of the footings F, such as in FIG. 3. Alternatively, the footing may be integrally formed with the module. Likewise, if the assembly is going to be supported on a floor then, for example as shown in FIG. 6, a floor F' can be put in place and the modules can be positioned on top of the floor F'. Alternatively, a floor can be integrally formed with a module such that a generally four sided structure is formed, or may be developed by use of inverting a first module for engagement with a second module, such as shown in FIG. 7. As is best illustrated in FIG. 5 the bottom surfaces of at least some of the supports, such as supports 12S-1, 12S-2 and 12G, may include offset surfaces. With this configuration, when stacking one set of modules atop an inverted like set of modules, the corresponding offset surfaces engage each other and facilitate stable stacking, as shown in FIG. 7. Preferably, when the modules are set on a floor or footing the bottom surface of the supports are flat as is shown with supports 12.

To manage water flow, it will be appreciated that an assembly of modules typically will include one or more inlet ports (not shown) to permit water to flow into the modules from areas outside of the assembly such as, for example, water that is accumulating at the ground level or water from other water storage areas located either at ground level or other levels. The inlet ports can be located at any elevation in order to permit fluid communication with existing water drains and conduits and are commonly fluidly connected to a ground level drain and its associated conduit. Inlet ports may be specifically customized as required by the preferred site requirements to allow for the direct inlet of water into the assembly. For example, the location of the ports may be preformed during the formation of a module, if a preferred location is known, or may be formed during installation using appropriate tools.

Inlet ports may either be located in deck members of the modules of an assembly either alone or in combination with side inlet ports. Side inlet ports may be placed in customized locations and elevations in the perimeter walls to receive storm water via pipes from remote locations of a site. Multiple such inlet ports may be provided. Also, the water can either be stored within the assembly or be permitted to exit the assembly using one or more passageways, typically in the form of outlet ports.

Managing water flow from an assembly also commonly may include the use of outlet ports. Thus, assembly outlet ports may be used to direct the water out of the assembly and preferably to one or more of the following offsite locations: a waterway, water treatment plants, another municipal treatment facility or other locations which are capable of receiving water. Such outlet ports may be formed in the floor or the perimeter walls of the assembly. Assembly outlet ports may be placed in various locations and at various elevations in the perimeter walls of the channel to release the water. By way of example, but not limitation, outlet ports preferably are sized generally smaller than the inlet ports to restrict the flow of storm water exiting the assembly. Alternatively, water may exit the assembly through the process of water absorption or percolation through a floor constructed of a perforate material or through other means, such as an impermeable floor having openings.

Given the robust construction of the modules, an assembly or some modules of an assembly may be configured to include an upper traffic surface to be used at grade level. This offers the economics of additional pavement not being required in the area of the storm water retention/detention channel. To enhance the visual attractiveness of the upper traffic surface of the deck of the modules, the upper surface may include architectural finishes which are either added to the top surface of the deck member or which may be embossed into the deck portion when it is manufactured using molds or other tooling. These embossed surfaces may include but not be limited to simulated brick in various patterns, such as illustrated in FIG. 9, simulated stone pavers, and graphic illustrations. Also, the deck portion may be configured to receive actual brick or stone pavers or cut stone, inset into the top surface of the deck portion as a further architectural enhancement. For example, the module in FIG. 1 may be provided with an upper surface with the assembly being installed at an elevation which allows the upper surface of an assembly to form the traffic surface of for example, a parking lot.

Turning to FIG. 6, it will be appreciated that an assembly may be formed with alternative modules at different locations within the assembly. For instance, FIG. 6 illustrates two alternative modules that may be placed adjacent each other to form an outer side wall and interior channels. In particular, a first module 110 is placed on a floor F' and is shown having a pair of supports 112 connected to and below a deck portion 114. First module 110 is somewhat similar to module 10 of FIG. 1, with a main section 18 above the supports 112 and first and second sections 120 extending from the main section 118 in a cantilevered manner. The supports 112 are spaced apart and, together with the underside of the main section 118, form an interior channel 126 in the longitudinal direction. However, each support 112 of module 110 does not include spaced apart leg sections that form a support channel therebetween in a lateral direction. In addition, the supports 112 do not include leg sections that are spaced from ends 124 of the module 110.

In FIG. 6, a side module 110S-2 is place on the floor F' and adjacent the first module 110. The side module 110S-2 is somewhat similar to side module 10S-2, shown in FIG. 5, with a support 112S-2 underneath a deck portion 114S-2, and a substantially vertical side wall 154 extending downward from the deck portion 114S-2 to rest on the floor F'. The support 112S-2 spaced from the side wall 154 and, together with the underside of the main section 118S-2, form an interior channel 126 in the longitudinal direction. The support 112S-2 also is spaced from a longitudinal side of the deck portion 114S-2, creating a cantilevered section 120S-2 extending from a main section 118S-2. This section 120S-2 extending from the main section 118S-2 abuts the adjacent section 120 extending from the main section 118. Moreover, the supports 112S-2 and 112 are spaced apart and, together with the underside of the sections 120S-2 and 120, form an outer channel 26' in the longitudinal direction. However, the support 112S-2 of side module 110S-2 does not include spaced apart leg sections to form a support channel therebetween in a lateral direction. Such combinations of first and side modules may be used at various locations within an assembly where lateral flow is not necessarily required.

Modules also may engage each other in a different way to create further example assemblies. For instance, FIG. 7 illustrates another example disclosure of an assembly that generally will be described herein as a double depth or double level configuration. When site specific elevations allow increased depths of up to 10 feet and more, an assembly may be constructed with two levels of modules disposed one above the other. FIG. 7 shows an arrangement of the modules which is similar to the view shown in FIG. 5, except that it includes a plurality of lower modules placed in a pattern that essentially includes an inverted placement of the assembly of FIG. 5, together with the assembly shown in FIG. 5 placed directly atop the lower modules.

In a double depth configuration, as illustrated in FIG. 7, each lower module 10S-1, 10P, 10S-2 and 10G preferably has a generally upward depending U-shape, so that the deck portions 14S-1, 14, 14S-2 and 14G now form a floor. Each upper module 10S-1, 10P, 10S-2 and 10G preferably has a generally downward depending U-shape and is stacked upright on the respective like lower modules. In other words, one of the upper and lower modules is preferably inverted approximately 180 degrees relative to the other. The supports of the upper module are vertically aligned with the supports of the lower module.

Placement of the double depth configuration preferably involves placing one or several adjacent lower modules in an excavated site and then placing the corresponding upper modules on top of the lower modules. These steps are preferably repeated until the entire assembly is completed, although other configurations and methods of placement are possible. For example, one or more rows or columns, or even all the lower modules in the entire reticulated assembly, may be placed in the site before placing the upper modules on top of their respective lower modules.

If desired, the upper and lower modules may be secured or fastened to each other using any conventional methods. By way of example, but not limitation, the upper and lower modules may be secured by an interlocking structure including offset engaging surfaces. Thus, to improve stability and alignment of the upper and lower supports, what would be considered the bottom surfaces of at least some of the supports when in an upright position, such as shown with supports 12S-1, 12S-2 and 12G in FIG. 5, may include offset surfaces. With this configuration, when stacking one set of modules atop an inverted like set of modules, the corresponding offset surfaces engage each other and facilitate stable stacking, as shown in FIG. 7. The channels formed by the upper and lower modules, thereafter form portions of larger channels 26D, 26D', 28D and 28D', which have an increased depth. Therefore, the double depth configuration further increases the interior volume of the assembly. In the illustrated embodiment, the lower modules 10S-1, 10P, 10S-2 and 10G include openings 70 that allow for fluid flow between channels 26D and 26D' before the water level rises to the height of channels 28D and 28D'. This allows for relatively unconstrained fluid flow even at low water levels in the assembly.

The double depth configuration of FIG. 7 has the advantage that the deck member of the lower module provides a floor which assists in structurally supporting the assembly on the underlying soil relative to vertical loads applied to the assembly. Thus, no secondary in-situ or precast concrete footing or floor is necessary. The channels formed by each of the upper and lower modules now also form portions of even larger channels which have an increased depth. So, it can be seen therefore that the double depth configuration further increases the interior volume of the assembly. The ranges of overall dimensions of each upper and lower module also may be similar to those previously described for a single depth module. As a consequence, the overall height dimension of the assembly is additive of the heights of both the upper and lower modules and provides a greater water storage capacity. However, it will be appreciated that the heights of the upper and lower module layers need not be the same, and may vary in relation to each other.

Turning to FIG. 8, a further example of a module is generally designated at 210. The illustrated module 210 includes two supports 212 and a deck portion 214 located on top of the supports 212. As with the first example shown in FIG. 1, the supports 212 are positioned underneath the deck portion 214 and spaced inwardly from longitudinal sides 216 of the deck portion 214. The supports 212 also extend downward from the deck portion 214 and are intended to rest on a solid base or footing, such as in the prior examples shown in FIGS. 3 and 6.

As with the prior examples, the deck portion 214 may be in the form of any selected shape, but is shown in the preferred configuration as a rectangular slab. The deck portion 214 includes a main section 218 and at least one further section 220 extending from the main section 218. The supports 212 are spaced inwardly from the longitudinal sides 216, such that the sections 220 extending from the main section 218 are cantilevered or overhang from the supports 212. The supports 212 also are spaced apart from one another. The supports 212 may further include leg sections 222. However, unlike the leg sections 22 of module 10 of the first example, which are spaced from ends 24 of the deck portion 14, the leg sections 222 of the example shown in FIG. 8 are not spaced from the ends of the deck portion 214. As with the first example module 10, while the supports 212 each have two leg sections 222, it will be appreciated that more or fewer leg sections 222 may be configured for each support 212 and more supports 212 may be positioned under the deck portion 214.

In order to manage the flow of water, module 210 defines an interior channel 226 which is preferably open at the ends of the module 210. The interior channel 226 is defined by the supports 212 and the main section 218 of the deck portion 214. As shown in FIG. 8, the interior channel 226 extends in the longitudinal direction of the module 210 to permit the flow of water in the longitudinal direction. The module 210 also may include support channels 228 in the lateral direction. In the example illustrated, the leg sections 222 are spaced apart to define a support channel 228 therebetween. Both the interior channel 226 and support channels 228 are in fluid communication with one another so as to permit water flow in the longitudinal and lateral directions.

As illustrated, each of the channels 226, 228 of the example module 210 in FIG. 8 extends to the bottom surface 230 of the supports 212, and thus to a footing or floor on which the module 210 sits. This configuration still allows for relatively unconstrained fluid flow through the module 210 regardless of the fluid level, however, it will be appreciated that it provides more direct loading through the supports 212 near the ends of the module 210. It will be appreciated that this type of configuration may be combined with other elements, such as an end wall, to form additional module constructions.

A further example module 310 is illustrated in FIGS. 9 and 10. As noted with respect to the example module 10 shown in FIG. 1, alternative module constructions may include support channels that do not extend to the bottom surface of the supports. For example, as shown in FIG. 9, a module 310 may include supports 312 positioned below a deck portion 314, but with one or more of the supports 312 including a window opening 313. Thus, leg sections 322 still are spaced apart over most of their height, but are connected by a lower support section 323, rather than having an opening therebetween that extends to the bottom surfaces 330 of the supports 312. This construction results in interior channels 326 formed between the supports 312, and channels 328 extending through the openings 313 in each support 312. In this example, the deck portion 314 includes a patterned upper surface, representing a brick surface, with the intention that the patterned surface will be at ground level when installed.

As best seen in FIG. 10, the deck portion 314 of example module 310 includes a main section 318 positioned over the supports 312, and sections 320 extending from the main portion 318. While the leg sections 322 of the supports 312 are spaced from the ends 324 of the deck portion 314, further structure is added to the supports 312 in the form of gussets 325 to assist in supporting the sections 320 that extend from the main section 318. It will be appreciated that various forms and shapes of gussets may be included to provide enhanced support for the sections 320.

Turning to FIGS. 11 and 12, which are exploded views, another example module 410 is illustrated as having an overall configuration much like that of the module 10 of FIG. 1, but being formed in separate pieces, as opposed to being integrally cast as one piece. Accordingly, the module 410 includes supports 412 that are positioned below a deck portion 414. Supports 412 also include separate leg sections 422. It also will be appreciated that the supports and leg sections may be integrally formed while the deck portion is a separate piece. Aside from the pieces being separately formed and then needing to be connected together at a later time, such as when installing the modules 410 in an assembly, the basic format and water management provided by the modules 410 is similar to that provided by the module 10. The connections between the various pieces may be affected in any suitable manner, and may therefore involve pins, fasteners, adhesives and the like. The pieces also may have modified configurations to assist in alignment or stability, such as for example, the deck portion 414 may include longitudinal keyways cut along the underside to receive the supports 412.

Figure 14:
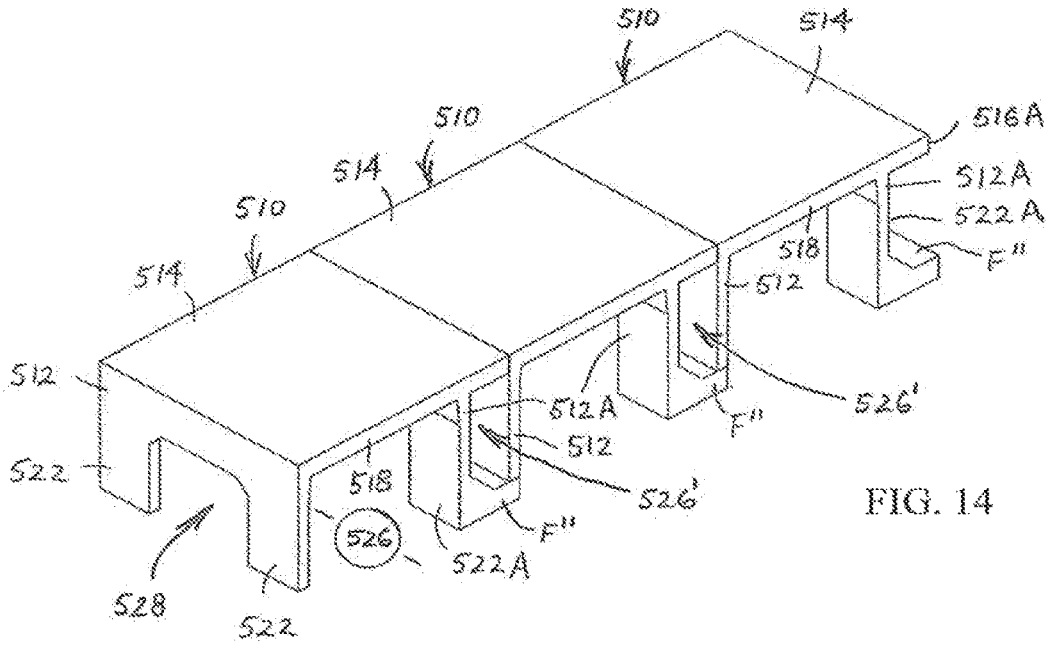
FIG. 14 is an upper perspective view of an assembly of three of the example modules shown in FIG. 13, with each integral footing being used by a support of an adjacent module.
Figure 15:
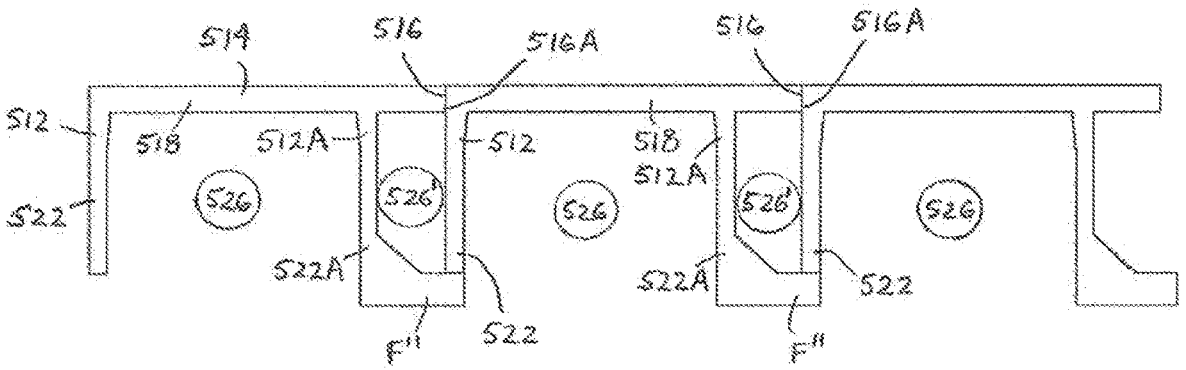
FIG. 15 is a side view of the assembly of modules shown in FIG. 14.

As discussed above, the supports of a module need to sit atop a footing, pad or floor to distribute the load of the module and any further loads applied thereto. However, as shown in FIGS. 13-15, a module itself may include at least one integral footing. Thus, for example, module 510 includes a first support 512 in the form of a side wall having an opening, and a second support 512A. The supports 512 and 512A are positioned below a deck portion 514. The supports 512 and 512A also are spaced apart and, together with a main section 518 of the deck portion 514, define a longitudinal channel 526.

The first support 512 is located along and beneath a first longitudinal side 516 of the deck portion 514, and includes leg sections 522. The leg sections 522 are spaced apart and define a lateral channel 528 therebetween. The second support 512A is spaced from the second longitudinal side 516A of the deck portion 514, creating a cantilevered section 520 extending from the main section 518. The leg sections 522A of support 512A are spaced apart and define a like lateral channel 528 therebetween. However, supports 512A also include integral footings F" formed at the lower end of leg sections 522A. It is appreciated that in some embodiments both leg sections of a module may include integral footings (not shown).

Typically, leg sections of a module are positioned upon the center of a footing such that the module is balanced on the footing. However, the integral footing F" as shown in FIGS. 13-15 extends from a leg section 522A. This arrangement allows for relatively balanced loading of adjacent modules onto the integral footing. The integral footings F" of module 510 are incorporated into an assembly when using additional modules that have a side wall, such as is provided by support 512. Thus, as shown in FIGS. 14 and 15, a series of modules 510 may be placed adjacent each other, so that the side wall support 512 of one module 510 sits atop the integral footing F" of the complementary support 512A. In this way, a footing would be needed for each module 510 at one end of an assembly, but the modules 510 would provide the necessary footings throughout the length of a series of similarly situated modules 510. Therefore, the weight placed on the integral footing of one module is balanced out by weight from an adjacent module. The placement of a side wall support 512 of an adjacent module on the integral footing F" may eliminate the structural moment otherwise imposed on the integral footing F" by the support 512A. In addition, when a support 512 is placed on an integral footing F", the support 512 also abuts the longitudinal side wall 516A of the deck portion 514. This arrangement creates a further longitudinal channel 526' defined by the section 520 extending from the main section 518, the integral footing F", and the supports 512 and 512A. It will be appreciated that various forms of integral footings may be included with a support.

From the foregoing description of the several examples of modules and underlying support surfaces, it will be appreciated that a method and apparatus are provided for managing the flow of water and/or retaining or detaining water, such as storm water, beneath a ground surface. In various aspects, one may practice the method preferably by placing a plurality of modules adjacent each other, so as to connect a plurality of longitudinal channels and to connect a plurality of lateral channels. The longitudinal channels preferably are each defined by at least one substantially horizontal deck portion and supports underlying the deck portion. At an outer boundary of an assembly, the longitudinal channels may be defined by a deck portion and by at least one substantially vertical side wall. The lateral channels are each defined preferably by a portion of a corresponding deck and a portion of a corresponding support, such as by an opening between spaced apart leg sections of a support.

Preferably, both the longitudinal and lateral channels have a somewhat similar cross-section, and are in longitudinal and lateral alignment to form continuous longitudinal and lateral channels, although similarity of cross-sections and direct alignments may not be necessary for a given site plan. The respective longitudinal and lateral channels also preferably are adjacent and in fluid communication with one another, although they may be disposed in other configurations as desired by the existing or planned underground obstacles. Further, it is preferred that each support has a bottom surface and that the longitudinal and lateral channels extend upwardly from a bottom surface of a support, to allow relatively unconstrained water flow in the both directions. However, as shown in FIG. 9, the openings forming lateral channels through modules need not necessarily extend to the bottom surface of a support.

The method further includes creating an outer boundary for the longitudinal and lateral channels by placing modules having side walls along the periphery of the assembly. As discussed above, portions of the peripheral side walls may include one or more assembly access inlet and/or outlet ports, to receive or release water.

In one aspect, the method includes connecting longitudinal and lateral channels which are defined by at least one interior module having a corresponding deck portion and at least one support. For example, an assembly may include connecting a plurality of interior modules, such as shown in FIG. 1, within an excavation site. The step of connecting the modules preferably includes aligning the ends of adjacent modules, so that the deck portions abut each other and the individual longitudinal channels of each interior module collectively form a continuous longitudinal channel through the entire assembly. Preferably, the step of connecting modules further includes aligning the sides of adjacent modules, so that the deck portions abut one another and the individual lateral channels of each interior module collectively form a continuous lateral channel through the entire assembly. Side modules, both in configuration for a longitudinal end or in a configuration for a lateral side, as well as corner modules may be placed peripherally around the interior modules in an aligned configuration, so that their corresponding longitudinal and lateral channels form additional portions of the continuous channels. As noted above, the substantially vertical walls of the supports that form side and corner modules are located at the periphery of the assembly and have either an imperforate or perforate surface and may define inlet and outlet ports.

For installation of an assembly, after a particular site has been excavated and the underground obstructions accounted for, a first module is placed into the ground. The first module may be any one of an interior module, a side module, or a corner module. Adjacent modules may be placed in longitudinal and lateral alignment with the first modules to form continuous longitudinal and lateral channels. However, it will be appreciated that the modules may be set in an offset brick-type pattern that may not provide alignment for the lateral channels. Given that interior modules are placed toward the interior of the assembly, while side and corner modules are placed at the periphery of the assembly to form side walls, end walls and corners, it can be seen that the modules may be placed in any order within the ground.

Although each module is shown as placed in end-to-end, side-by-side and in adjacent alignment, it is also possible to place the modules in a spaced apart configuration with connecting portions spanning between the spaced apart modules. Also, the assembly access inlet and outlet ports can be located in predetermined locations or formed in the side portions during installation in order to ensure that the inlet and outlet ports are aligned with existing underground drains and conduits. Alternatively, an outlet port may not be required where the floor of the assembly is perforate such as, for example, where the floor includes one or more openings or is formed of a porous or aggregate material which allows for percolation and absorption of the water into the ground.

The assemblies typically are designed for water to flow into the assembly through one or more inlet ports, and to store the water for a certain interval of time. The water then is allowed to flow out of the assembly either through one or more outlet ports, through a porous or perforate floor, or a combination of both. During entry and storage of water, such as storm water, the lateral and longitudinal aligned channels allow relatively unconstrained water flow within the assembly. An assembly also may be sloped such that a portion of the assembly having an inlet port is located at a slightly higher elevation, while a portion of the assembly having an outlet port is located at a lower elevation. This configuration will assist the tendency of the water to flow under the influence of gravity.

In another aspect of the disclosure, the method may include the step of installing a plurality of modules within the ground at a depth that will leave the top surface of at least one of the deck portions exposed, or at a depth at which none of the top surfaces of the deck portions will be exposed. A further installation may be achieved by installing at a relatively greater depth in the ground a first plurality of modules in an inverted configuration whereby the deck portion now forms a floor and the U-shape is upwardly depending, and then placing a second plurality of corresponding modules in an upright configuration, having the U-shape downwardly depending and being stacked atop the inverted modules. Lateral and longitudinal channels may be aligned to ensure relatively uninterrupted fluid communication through the assembly. Alternatively, a first set of modules may be placed in an upright manner forming a first level, and then a second set of modules may be placed atop the first level so as to form an upper second level of modules.

From the foregoing discussion, it will be appreciated that various examples have been disclosed that possess or permit various applications or configurations of assemblies for the management of water beneath a ground surface. While the underground modular assemblies herein disclosed constitute preferred example configurations, it is understood that the disclosure is not limited to these precise example modules for forming underground channels and that changes may be made therein. For example, the openings which define the longitudinal and lateral channels may have several geometric shapes other than those illustrated. It also is realized that many other geometric configurations for modular assemblies are possible. Moreover, it will be understood that one need not enjoy all of the potential advantages disclosed herein to practice the presently claimed subject matter.

What is claimed is:

1. A module for use in an assembly including a plurality of modules for managing the retention or detention of fluid beneath a ground surface comprising:

a deck portion having a top and bottom, opposing first and second side edges and opposing first and second end edges;

first and second legs, the legs being spaced apart from one another, the legs extending below the bottom of the deck portion proximate the first side edge of the deck portion, the first and second legs being spaced inwardly from the first side edge of the deck portion;

a support extending from the bottom of the deck portion proximate the second side edge of the deck portion, the support extending along the bottom of the deck portion in a first direction;

wherein the deck portion has a main deck section and a first overhanging section, the main deck section being located between the first and second spaced apart legs and the support, the first overhanging section extending laterally outward from the main deck section beyond the first and second spaced apart legs to the first side edge of the deck portion;

an interior fluid path defined by a bottom portion the main deck section, at least one of the first and second spaced apart legs and the support, the interior fluid path permitting fluid flow in the first direction below the bottom of the deck portion, a lateral fluid path defined between the first and second spaced apart legs, the lateral fluid path permitting fluid flow in a second direction below the bottom of the deck portion, the lateral fluid path being in fluid communication with the interior fluid path, and wherein the first and second spaced apart legs together with a bottom surface of the first overhanging section define an area below the first overhanging section partially forming a first outer fluid path when the module is placed adjacent to a second module having a corresponding overhanging section, portions of the first outer fluid path being parallel to the interior fluid path, wherein the first outer fluid path permits fluid flow in the first direction and is in fluid communication with the lateral fluid path and interior fluid path, the first outer fluid path being joined to the interior fluid path by the lateral fluid path.

2. The module of claim 1 wherein the first leg is closer to the first end edge of the deck portion than the second end edge, the first leg partially defining a first end area below the bottom of the deck portion adjacent the first end edge, said first end area partially forming a first outer lateral fluid path in fluid communication with the interior fluid path and the lateral fluid path when the module is placed adjacent to a second module having a corresponding first end area.

3. The module of claim 2 wherein the support extending from the bottom of the deck portion is spaced inwardly from the second side edge of the deck portion so that the deck portion includes a second overhanging section opposite the first overhanging section.

4. The module of claim 3 wherein the main deck section is located between the first and second overhanging sections, the second overhanging section extending laterally outward from the main deck section beyond the support to the second side edge of the deck portion.

5. The module of claim 4 wherein the support together with a bottom surface of the second overhanging section define an area below the second overhanging section partially forming a second outer fluid path when the module is placed adjacent to a second module having a corresponding second overhanging section, portions of the second outer fluid path being parallel to the interior fluid path and first outer fluid path, wherein the second outer fluid path permits fluid flow in the first direction and is in fluid communication with the lateral fluid path, interior fluid path, first outer fluid path and first outer lateral fluid path.

6. The module of claim 5 wherein the second leg is closer to the second end edge of the deck portion than the first end edge, the second leg partially defining a second end area below the bottom of the deck portion adjacent the second end edge, said second end area partially forming a second outer lateral fluid path in fluid communication with the interior fluid path, the lateral fluid path and the first and second outer fluid paths and the first outer lateral fluid path when the module is placed adjacent to a second module having a corresponding second end area.

7. The module of claim 1 wherein the support is a side wall extending from the second side edge of the deck portion, the side wall extending along the deck portion between the opposing end edges.

8. The module of claim 1 wherein the module is formed of a single integrally-formed piece of precast concrete.

9. An assembly for managing the retention or detention of fluid beneath a ground surface comprising:

a plurality modules, each module of the plurality of modules comprising:

a deck portion having a top and bottom, opposing first and second side edges and opposing first and second end edges;

first and second legs, the legs being spaced apart from one another, the legs extending below the bottom of the deck portion proximate the first side edge of the deck portion, the first and second legs being spaced inwardly from the first side edge of the deck portion;

a support extending from the bottom of the deck portion proximate the second side edge of the deck portion;

wherein the deck portion has a main deck section and a first overhanging section, the main deck section being located between the first and second spaced apart legs and the support, the first overhanging section extending laterally outward from the main deck section beyond the first and second spaced apart legs to the first side edge of the deck portion;

an interior fluid path defined by a bottom portion the main deck section, at least one of the first and second spaced apart legs and the support, the interior fluid path permitting fluid flow in a first direction below the bottom of the deck portion, a lateral fluid path defined between the first and second spaced apart legs, the lateral fluid path permitting fluid flow in a second direction below the bottom of the deck portion, the lateral fluid path being in fluid communication with the interior fluid path;

wherein the first and second spaced apart legs together with a bottom surface of the first overhanging section define an area below the first overhanging section partially forming a first outer fluid path when the module is placed adjacent to a second module having a corresponding overhanging section, portions of the first outer fluid path being parallel to the interior fluid path, wherein the first outer fluid path permits fluid flow in the first direction and is in fluid communication with the lateral fluid path and interior fluid path, the first outer fluid path being joined to the interior fluid path by the lateral fluid path, and wherein, the plurality of modules comprises a plurality of first modules further comprising:

the support being spaced inwardly from the second side edge of the deck portion;

a second overhanging section, the main deck section being located between the first and second overhanging sections, the second overhanging section extending laterally outward from the main deck section beyond the support to the second side edge of the deck portion;

wherein the support together with a bottom surface of the second overhanging section define an area below the second overhanging section partially forming a second outer fluid path when the first module is placed adjacent to a second module having a corresponding second overhanging section, portions of the second outer fluid path being parallel to the interior fluid path and first outer fluid path, wherein the second outer fluid path permits fluid flow in the first direction and is in fluid communication with the lateral fluid path, interior fluid path and first outer fluid path and first outer lateral fluid path.

10. The assembly of claim 9 wherein each module of the plurality of modules further comprises an arrangement wherein the first leg is closer to the first end edge of the deck portion than the second end edge, the first leg partially defining a first end area below the bottom of the deck portion adjacent the first end edge, said first end area partially forming a first outer lateral fluid path in fluid communication with the interior fluid path and the lateral fluid path when the module is placed adjacent to a second module of the plurality of modules having a corresponding first end area.

11. The assembly of claim 10 wherein each module of the plurality of first modules further comprises an arrangement wherein the second leg is closer to the second end edge of the deck portion than the first end edge, the second leg partially defining a second end area below the bottom of the deck portion adjacent the second end edge, said second end area partially forming a second outer lateral fluid path in fluid communication with the interior fluid path, the lateral fluid path, the first and second outer fluid paths and the first outer lateral fluid path when the first module is placed adjacent to a second module of the plurality of modules having a corresponding second end area.

12. The assembly of claim 10 wherein the plurality of modules are arrangeable in at least one of a plurality of rows and a plurality of columns.

13. The assembly of claim 12 wherein the plurality of rows comprise at least two modules of the plurality of modules positioned adjoining one another side by side, wherein a first overhanging section of one module of the at least two modules is positioned alongside a first overhanging section of a second module of the at least two modules, wherein the area below the first overhanging section of the one module joins the area below the first overhanging section of the second module to form the first outer fluid path.

14. The assembly of claim 12 wherein the plurality of rows comprise at least two modules of the plurality of modules positioned adjoining one another side by side, wherein a second overhanging section of one module of the at least two modules is positioned alongside a second overhanging section of a second module of the at least two modules, wherein the area below the second overhanging section of the one module joins the area below the second overhanging section of the second module to form the second outer fluid path.

15. The assembly of claim 12 wherein the plurality of columns comprise at least two modules of the plurality of modules positioned adjoining one another end to end, the first end edge of one module of the at least two modules being positioned alongside first opposing end edge of a second module of the at least two modules, wherein the area below the bottom of the deck portion adjacent the first opposing end edge of the first module joins the area below the bottom of the deck portion adjacent the first end edge of the second module to form the first outer lateral fluid path.

16. The assembly of claim 10 wherein the plurality of first modules and at least one side module are each formed of a single integrally-formed piece of precast concrete.

17. The assembly of claim 9 wherein the plurality of modules further comprises at least one side module wherein the support is a side wall extending from the second side edge of the deck portion, the side wall extending along the deck portion between the opposing end edges.

18. The assembly of claim 9 wherein the plurality of modules is arrangeable in a first level of modules and a second level of modules on top of the first level of modules, wherein modules in the second level are stacked atop and supported by supported by modules in the first level, wherein modules in the first level are positionable in an inverted configuration with the first and second spaced apart legs and support extending upward from the deck portion, modules in the second level are positionable in an upright configuration on top of the first level, wherein the first and second spaced apart legs and support of each module of the plurality of modules have a bottom surface opposite the deck portion, wherein the bottom surface of the spaced apart legs and support of a module in the first level is engagable with the bottom surface of the spaced apart legs and support of a module in the second level.

19. A method for managing the retention or detention of fluid beneath a ground surface comprising:

providing a plurality of first modules, each of the plurality of first modules comprising:

a deck portion having a top and bottom, opposing first and second side edges and opposing first and second end edges;

first and second spaced apart legs extending below the bottom of the deck portion proximate the first side edge of the deck portion, the first and second legs being spaced inwardly from the first side edge of the deck portion and the opposing end edges of the deck portion;

a support extending from the bottom of the deck portion proximate the second side edge of the deck portion;

wherein the deck portion has a main deck section and first and second overhanging sections, the main deck section being located between the first and second spaced apart legs and the support, the first overhanging section extending laterally outward from the main deck section beyond the first and second spaced apart legs to the first side edge of the deck portion, the second overhanging section extending laterally outward from the main deck section opposite the first overhanging section beyond the support to the second edge of the deck portion;

an interior fluid path defined by a bottom portion of the main deck section, at least one of the first and second spaced apart legs and the support, wherein the interior fluid path permits fluid flow in a first direction below the bottom of the deck portion, a lateral fluid path defined between the first and second spaced apart legs, wherein portions of the lateral fluid path permit fluid flow in a second direction below the bottom of the deck portion, the lateral fluid path being in fluid communication with the interior fluid path;

the first and second spaced apart legs together with a bottom surface of the first overhanging section defining an area below the first overhanging section, the support together with a bottom surface of the second overhanging section defining an area below the second overhanging section and the first spaced apart leg being closer to the first end edge of the deck portion than the second end edge, the first spaced apart leg defining an area below the bottom of the deck portion adjacent the first end edge, the second spaced apart leg defining an area below the bottom of the deck portion adjacent the second end edge;

placing the plurality of first modules beneath a ground surface in at least one of a plurality of rows and a plurality of columns;

forming a first outer fluid path permitting fluid flow in the first direction, the first outer fluid path being formed by placement of two adjoining modules of the plurality of modules in a side by side arrangement, said placement joining the area below the first overhanging section of one module of the two adjoining modules with the area below the first overhanging section of a second module of the two adjoining modules, and forming a second outer fluid path permitting fluid flow in the first direction, the second outer fluid path being formed by placement of two adjoining modules of the plurality of modules in a side by side arrangement, said placement joining the area below the second overhanging section of one module of the two adjoining modules with the area below the second overhanging section of a second module of the two adjoining modules, and forming an outer lateral fluid path permitting fluid flow in the second direction, the outer lateral fluid path being formed by placement of two adjoining modules of the plurality of modules in an end to end arrangement, said placement joining the area below the bottom of the deck portion adjacent the first opposing end edge of one module of the two adjoining modules with the area below the bottom of the deck portion adjacent the first end edge of the second adjoining module.

20. The method of claim 19 further comprising:

providing a side module, the side module having a side wall extending from the second side edge of the deck portion, the side wall extending along the deck portion between the opposing first and second end edges, and placing the side module beneath the ground surface alongside a first module.

21. The method of claim 19 further comprising placing the plurality of modules in a first level of modules and a second level of modules on top of the first level of modules, said placing comprising:

positioning the first level of modules in an inverted configuration with the first and second spaced apart legs and support extending upward from the deck portion;

positioning the second level of modules in an upright configuration stacked on top of the first level of modules wherein the modules in the second level are supported by modules in the first level.

22. A module for use in an assembly including a plurality of modules for managing the retention or detention of fluid beneath a ground surface comprising:

a deck portion having first and second side edges and first and second end edges, the deck portion having top and bottom portions;

two legs extending from the bottom portion of the deck portion, each leg being proximate to the first side edge of the deck portion;

a support member extending below the deck portion, the support member being farther from the first side edge of the deck portion than the two legs;

wherein the deck portion overhangs the support member and the legs;

a first interior fluid path in the module, the first interior fluid path having said legs on one side thereof and said support member on an opposite side thereof, the first interior fluid path extending in a first direction;

a second interior fluid path in the module, the second interior fluid path passing between said legs in a second direction;

a third fluid path located beneath a section of the deck portion that overhangs the legs;

the first, second, and third fluid paths being in fluid communication;

wherein the module is formed of a single integrally-formed piece of precast concrete;

wherein the legs and the support member extend to the bottom of the module;

wherein each of the first, second, and third fluid paths permits substantially unrestricted fluid flow within the module.

23. The module of claim 22 wherein the module further comprises a fourth fluid path located beneath a section of the deck portion that overhangs the support member, and wherein the fourth fluid path is in fluid communication with the first, second and third fluid paths.

24. The module of claim 22 wherein the support member is a sidewall which extends downward from the second side edge of the module.

25. A module for use in an assembly including a plurality of modules for managing the retention or detention of fluid beneath a ground surface comprising:

a deck portion having first and second side edges and first and second end edges, the deck portion having top and bottom portions;

two legs extending below the bottom portion of the deck portion, each leg being proximate to the first side edge of the deck portion;

a support member extending below the deck portion, the support member being farther from the first side edge of the deck portion than the two legs;

wherein the deck portion overhangs the support member and the legs;

a first interior region in the module, the first interior region being partially defined by said legs on one side thereof and said support member on an opposite side thereof, the first interior region extending in a first direction;

a second interior region in the module, the second interior region passing between said legs in a second direction;

a third region beneath a section of the deck portion that overhangs the legs;

the first, second, and third regions being in fluid communication;

wherein the module is formed of a single integrally-formed piece of precast concrete;

wherein the legs and the support member extend to the bottom of the module;

wherein each of the first, second, and third regions permits substantially unrestricted fluid flow around the bottom of the module.

26. The module of claim 25 wherein the module further comprises a fourth region located beneath a section of the deck portion that overhangs the support member, and wherein the fourth region is in fluid communication with the first, second and third regions.

27. The module of claim 25 wherein the support member extends downward from the second side edge of the module.

* * * * *